US008330383B2

(12) United States Patent
Man et al.

(10) Patent No.: US 8,330,383 B2
(45) Date of Patent: Dec. 11, 2012

(54) METHOD AND SYSTEM FOR DEPENDENTLY CONTROLLING COLOUR LIGHT SOURCES

(75) Inventors: Kwong Man, Vancouver (CA); Duncan Smith, Surrey (CA)

(73) Assignee: Koninklijke Philips Electronics N.V., Eindhoven (NL)

( * ) Notice: Subject to any disclaimer, the term of this patent is extended or adjusted under 35 U.S.C. 154(b) by 295 days.

(21) Appl. No.: 12/598,054

(22) PCT Filed: Apr. 23, 2008

(86) PCT No.: PCT/CA2008/000763

§ 371 (c)(1),
(2), (4) Date: Apr. 23, 2010

(87) PCT Pub. No.: WO2008/131525

PCT Pub. Date: Nov. 6, 2008

(65) Prior Publication Data

US 2010/0207544 A1 Aug. 19, 2010

Related U.S. Application Data

(60) Provisional application No. 60/914,976, filed on Apr. 30, 2007.

(51) Int. Cl.
*H05B 41/16* (2006.01)

(52) U.S. Cl. ..... 315/247; 315/185 S; 315/224; 315/291; 315/307

(58) Field of Classification Search ..... 315/247, 315/185 S, 224, 225, 291, 307–326
See application file for complete search history.

(56) References Cited

U.S. PATENT DOCUMENTS

| | | | | |
|---|---|---|---|---|
| 7,014,336 | B1 | 3/2006 | Ducharme et al. | |
| 7,329,998 | B2 * | 2/2008 | Jungwirth | 315/291 |
| 2005/0237733 | A1 | 10/2005 | Laski et al. | |
| 2005/0248944 | A1 | 11/2005 | Sloan | |

FOREIGN PATENT DOCUMENTS

| | | | |
|---|---|---|---|
| WO | 2006015476 | A1 | 2/2006 |
| WO | 2006056052 | A1 | 6/2006 |
| WO | 2006105649 | A1 | 10/2006 |
| WO | 2007090283 | A1 | 8/2007 |

* cited by examiner

*Primary Examiner* — Tuyet Thi Vo
(74) *Attorney, Agent, or Firm* — Mark L. Beloborodov

(57) ABSTRACT

A method and system for dependently controlling color light sources. The lighting system comprises a drive current controller providing current signals for one or more first groups of light-emitting elements, and a signal derivation module operatively connected to the drive current controller. The signal derivation module is configured to determine and provide current signals for one or more second groups of light-emitting elements, the current signals being based on the current signals provided to the first groups of light-emitting elements. The method comprises the steps of determining one or more first drive currents for driving one or more first groups of light-emitting elements, and determining one or more second drive currents for driving one or more second groups of light-emitting elements, wherein each of the one or more second drive currents is predetermined based on at least one of the one or more first drive currents.

17 Claims, 3 Drawing Sheets

METHOD AND SYSTEM FOR DEPENDENTLY CONTROLLING COLOUR LIGHT SOURCES

FIELD OF THE INVENTION

The present invention pertains to lighting control and more particularly to control of different colour light sources.

BACKGROUND

A number of methods and apparatus for the control of chromaticity of mixed light emitted from different colour light sources are known in the art. It is also known that the set of single wavelengths or frequencies of the visible or near-visible portions of the electromagnetic spectrum can be expressed as a subset of chromaticity values, known as the spectral locus. Light sources with relatively narrow-band emission spectra such as certain types of light-emitting diodes (LEDs), for example, can be engineered to effectively generate light of a desired chromaticity. Also light from different colour LEDs can be mixed to generate light of a desired chromaticity, provided the desired chromaticity is within the achievable colour gamut. For this purpose different colour LEDs are typically combined with a suitable optical system in the form of a luminaire or fixture. It is known that a suitably designed luminaire that is based on an adequately controlled number of LEDs of different colour, for example, red, green and blue (RGB) LEDs, can generate light of a variety of chromaticities within a gamut defined by the individual chromaticities of the LEDs. It is also known that multi-colour LED based luminaires can also be used to generate white light of variable correlated colour temperature (CCT) as white light is a subset of chromaticities, known as the Planckian locus. The colour rendering index (CRI) of mixed light generated by a multi-colour light source based luminaire can be improved in a number of different ways by adding new light sources with different colours to the luminaire or, within limits, by broadening the spectral bandwidths of one or more of the colour light sources in the luminaire, which, however, may reduce the overall colour gamut of the luminaire. This is specifically relevant for white light sources for which high CRIs are often desirable.

There are a number of systems and methods for the control of multi-colour light sources based luminaires, for example, multi-colour LED based luminaires, known in the art.

For example, International Patent Application Publication No. WO/2007/090283 describes a light source intensity control system and method. The light source comprises one or more first light-emitting elements for generating light having a first wavelength range and one or more second light-emitting elements for generating light having a second wavelength range. The first light-emitting elements and second light-emitting elements are responsive to separate control signals provided thereto. A control system receives a signal representative of the operating temperature from one or more sensing devices and determines first and second control signals based on the desired colour of light and the operating temperature. The light emitted by the first and second light-emitting elements as a result of the received first and second control signals can be blended to substantially obtain the desired colour of light. The desired colour of light generated can thus be substantially independent of junction temperature induced changes in the operating characteristics of the light-emitting elements.

International Patent Application Publication No. WO/2006/105649 describes a white light luminaire with adjustable correlated colour temperature. The luminaire system comprises one or more white light light-emitting elements for generating white light having a particular colour temperature. The system further comprises one or more first colour light-emitting elements and one or more second colour light-emitting elements. The luminaire system mixes the coloured light generated by the first and second colour light-emitting elements with the white light of a particular colour temperature, in order to create white light having a desired correlated colour temperature.

U.S. Pat. No. 7,014,336 describes systems and methods for generating and modulating illumination conditions. The systems and methods for generating and/or modulating illumination conditions can generate high-quality light of a desired and controllable colour, for creating lighting fixtures for producing light in desirable and reproducible colours, and for modifying the colour temperature or colour shade of light within a prespecified range after a lighting fixture is constructed. In one embodiment, LED lighting units capable of generating light of a range of colours are used to provide light or supplement ambient light to afford lighting conditions suitable for a wide range of applications.

United States Patent Application Publication No. 2005/0237733 describes a method and system for controlling lighting to reduce energy consumption of the light sources by changing at least one of the colour rendering index (CRI) and the correlated colour temperature (CCT) while maintaining illumination levels. The method and system sense movement of people in the space relative to light sources that light the space, and automatically and individually adjust plural solid state lighting devices that form each of the respective light sources to a first lighting condition when people are in a first position, wherein the lamps respectively emit light of a first illumination level and a first CRI at a first electrical power level, and to a second lighting condition when people are in a second position, wherein the light sources respectively emit light of the first illumination level and a smaller CRI than the first CRI and at a lower electrical power level than the first electrical power level.

Known methods and apparatus, however, are complex or require a scale-up of the number of components with the number of colours of light sources and therefore can be uneconomical. Therefore, there is a need for a new method and system for controlling multi-colour light sources based luminaires.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a method and system for dependently controlling colour light sources. In accordance with an aspect of the present invention there is provided a lighting system for controlling colour light sources comprising: a drive current controller for providing one or more primary drive current signals; one or more first groups of light-emitting elements, each first group operatively connected to the drive current controller and each first group responsive to a primary drive current indicative of one of the one or more primary drive current signals; a signal derivation module operatively connected to the drive current controller for determining one or more secondary drive current signals; and one or more second groups of light-emitting elements, each second group operatively connected to the signal derivation module and each second group responsive to a secondary drive current indicative of one of the one or more secondary drive current signals; wherein each of the one or more secondary drive current signals is predetermined.

In accordance with another aspect of the present invention, there is provided a lighting system control method comprising the steps of: determining one or more primary drive currents for driving one or more first groups of light-emitting elements, and determining one or more secondary drive currents for driving one or more second groups of light-emitting elements, wherein each of the one or more secondary drive currents is predetermined based on at least one of the one or more primary drive currents.

DETAILED DESCRIPTION OF THE INVENTION

Definitions

Figure 1:
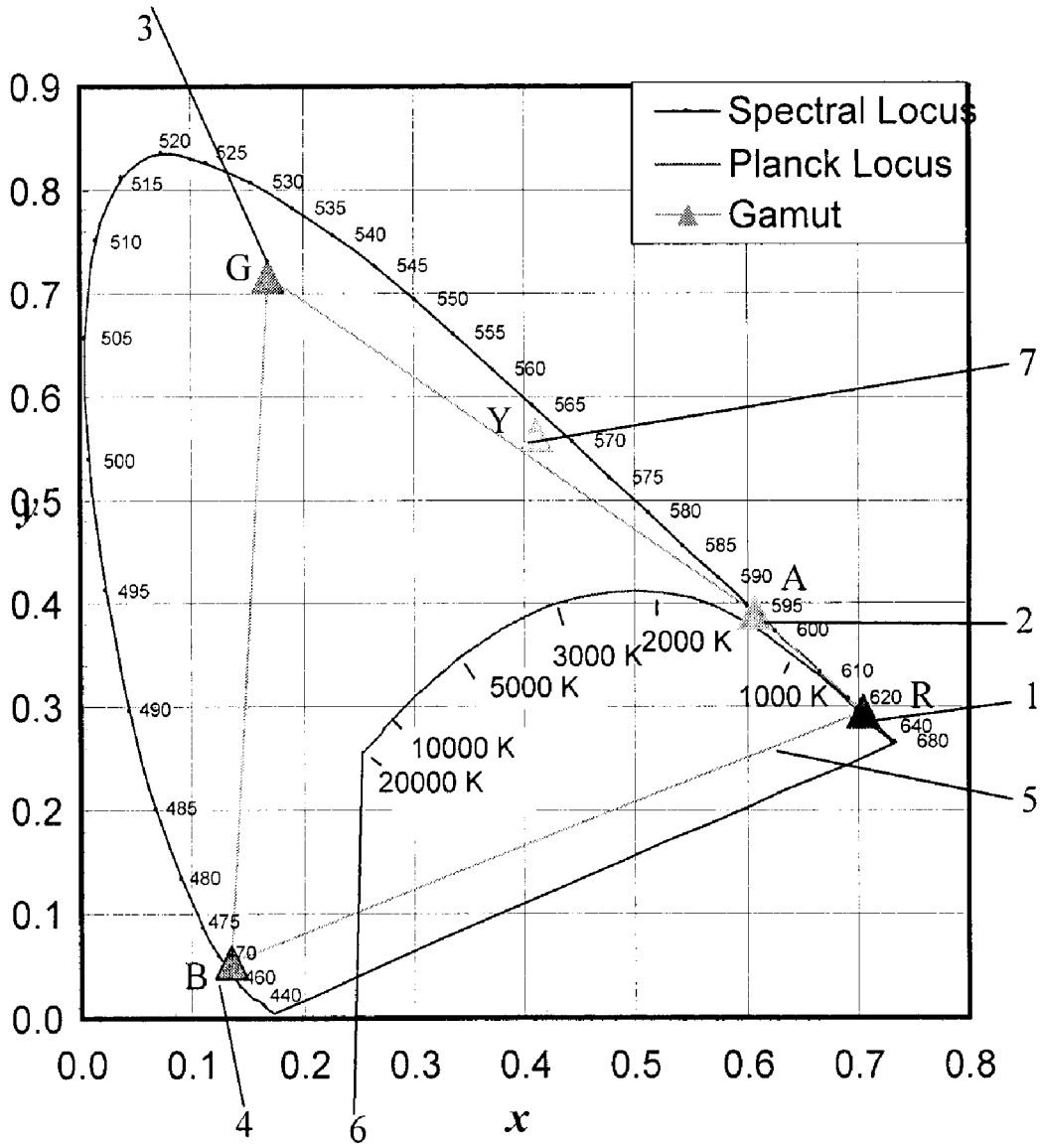
FIG. 1 illustrates a chromaticity diagram.

The term "light-emitting element" (LEE) is used to define a device that emits radiation in a region or combination of regions of the electromagnetic spectrum, for example, the visible region, infrared or ultraviolet region, when activated by applying a potential difference across it or passing an electrical current through it, because of, at least in part, electroluminescence. LEEs can have monochromatic, quasi-monochromatic, polychromatic or broadband spectral emission characteristics. Examples of LEEs include semiconductor, organic, or polymer/polymeric light-emitting diodes (LEDs), optically pumped phosphor coated LEDs, optically pumped nano-crystal LEDs or other similar devices as would be readily understood. Furthermore, the term LEE is used to define the specific device that emits the radiation, for example a LED die, and can equally be used to define a combination of the specific device that emits the radiation together with a housing or package within which the specific device or devices are placed.

The term "colour" is used, as the case may be, synonymously with "chromaticity" or in line with traditional definitions as expressed by names such as blue, red, green, etc.

The term "modulation parameter" refers to the ratio of the current LEE intensity to the maximum design LEE intensity.

As used herein, the term "about" refers to a +/−10% variation from the nominal value. It is to be understood that such a variation is always included in any given value provided herein, whether or not it is specifically referred to.

Unless defined otherwise, all technical and scientific terms used herein have the same meaning as commonly understood by one of ordinary skill in the art to which this invention belongs.

The present invention provides a method and system for dependently controlling different colour light sources. According to the present invention a N-colour light source based intensity modulated lighting system can be extended by M colour light sources that each have nominal colour different from the nominal colours of the N light sources. It is understood that M can be any positive integer number, i.e. M can be 1, 2, 3 etc. The M colour light sources can be controlled using modulation signals that can be derived from the modulation signals of one, two or more of the N light sources. For example, in one embodiment of the present invention the modulation parameter for the N+1 light source can be determined based on a predetermined function of the modulation parameters of two or more of the N colour light sources.

According to the present invention, the lighting system for controlling colour light sources comprises a drive current controller for providing one or more primary drive currents to one or more first groups of light-emitting elements to which it is operatively connected. The system further comprises a signal derivation module operatively connected to the drive current controller, wherein the signal derivation system is configured to determine one or more secondary drive currents which are dependently determined based on one or more of the primary drive currents. The one or more secondary drive currents are provided to one or more second groups of light-emitting elements for control thereof.

In general, adding an additional controllable colour light source to a lighting system can increase the gamut of the lighting system. It is noted, however, that choosing a function or configuration of the signal derivation module that configures a secondary drive current such that it depends too closely on one of the primary drive currents may limit the potential colour gamut achievable by the overall lighting system. For example, this can be an important consideration for a lighting system designed to be used for predominantly off-white colour generation. An example of such an embodiment includes a red, green, blue and amber (RGBA) colour lighting system in which the amber colour light source(s) are dependently controlled, for example, as a function of the red and green colour light sources.

In addition, a fifth, sixth or further light source colour may be added to the lighting system, wherein the control of these further light source colours may be independent of or dependent upon one or more of the primary drive current signals. For example, a fifth light source can be a cyan LEE.

FIG. 1 illustrates a chromaticity diagram (using CIE 1931 x,y-coordinate space). An example lighting system according to an embodiment of the present invention can include a red, amber, green and blue (RGBA) colour light sources with respective chromaticity coordinates 1, 2, 3 and 4. A yellow 7 colour light source can be used in place of or in addition to amber 2 colour light source, for example. These RGBA light sources in a lighting system configured for white light generation can be controlled to emit adequate amounts of light that, when mixed, exhibits chromaticities on or in the proximity of the Planckian locus 6. A luminaire with generally variable colour light can be controlled to emit light within substantially any desired portion of the colour gamut defined by the individual colours of the light sources of the lighting system. It is noted, that as is illustrated in FIG. 1, if the four light sources were independently controlled, the colour gamut of the lighting system would be substantially defined by polygon 5. With this consideration, according to one embodiment of the present invention, in order to substantially preserve the substantially triangular shaped colour gamut of the RGB colour lighting system while using an amber colour light source 2 which is dependently controlled, it can be desirable that the dependently controlled amber light emitting element emits substantially zero light if either the amount of red or the amount of green light approaches zero.

In one embodiment, if the total intensity of light from the luminaire is decreased, the intensity of dependently controlled light sources is decreased in a manner that preserves the desired chromaticity of light at the desired intensity. For example, with reference to FIG. 1, if the amounts of red, green and blue light are decreased, it can be desirable that the amount of light emitted by the dependently controlled amber light-emitting element also decreases, so as to prevent the chromaticity of the combined light from shifting undesirably close to the amber region.

Lighting System

Figure 2:
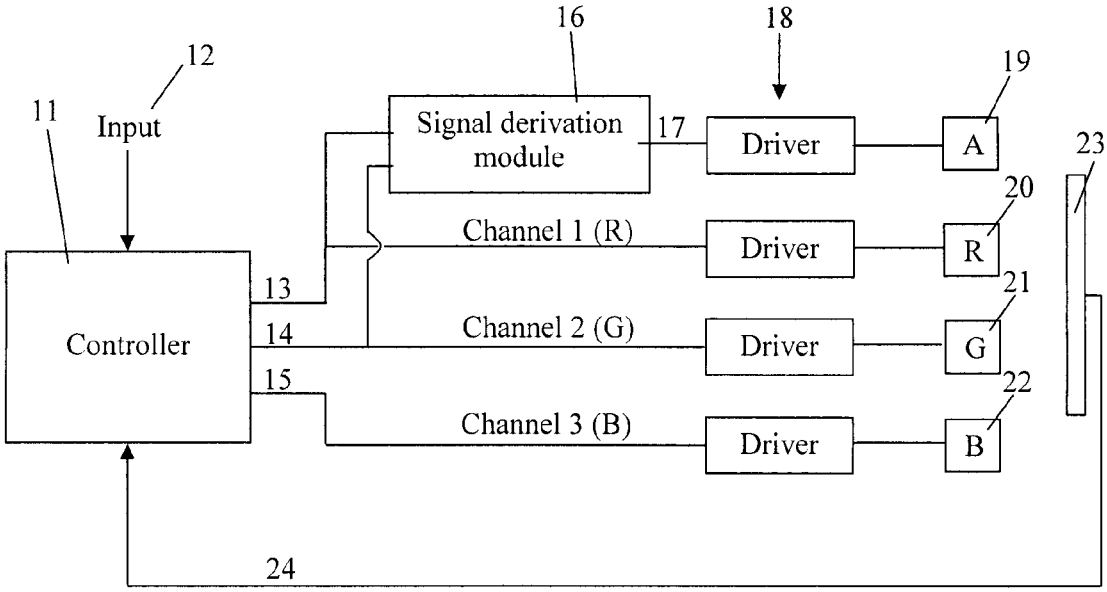
FIG. 2 illustrates a block diagram of a system for dependently controlling colour light sources according to one embodiment of the present invention.

FIG. 2 illustrates a system for dependently controlling colour light sources according to one embodiment of the present invention. As illustrated a controller 11 sets the desired chromaticity coordinates and/or intensity of the light to be generated by the lighting system. The desired chromaticity coordinates can be provided to controller 11 by a user via a user interface 12. The controller can comprise hardware and firmware configured for controlling three output channels 13, 14 and 15, each channel corresponding respectively to nominal red, green and blue colour light sources. The red and green control signals 13 and 14 can each be fed into a signal derivation module 16, in which the amber control signal 17 is determined according to a predetermined functional relationship. Control signals for red 13, green 14, blue 15 and amber 17 light sources are then each fed into respective drivers 18. Each driver supplies electrical current to the red 19, amber 20, green 21 and blue 22 light sources. The drivers can provide the light sources with analog modulated, pulse width modulated (PWM), pulse code modulated (PCM), random digital signals or other forms of drive currents.

In one embodiment, an optional sensor 23, can be used to sense an adequate portion of the light generated by the lighting system and provide a feedback signal 24 to the controller 11. The controller 11 can utilize the feedback signal 24 to further adjust the chromaticity and intensity of the light generated by the lighting system.

In one embodiment, the light sources, for example red 19, amber 20, green 21 and blue 22 light sources, can be selected from a variety of light source configurations which can include light-emitting elements such as one or more semiconductor, organic, or polymer/polymeric LEDs, optically pumped phosphor coated LEDs, optically pumped nanocrystal LEDs or other similar devices as would be readily understood. The light sources can be provided in one or more of a variety of configurations as would be understood by a worker skilled in the art. For example, LEEs of the same colour or a blend of different colours can be integrated into a single package, or a single LEE can be provided within a package. In one embodiment, each light source comprises primary output optics such as a reflector, a lens, or the like. In another embodiment, each light source further comprises secondary optics for further combining and mixing the light source's output.

In one embodiment, one or more feedback sensors, for example optional sensor 23, are operatively coupled to the lighting system in order to provide one or more signals indicative of the operational characteristics of the light sources. A feedback sensor can include elements such as one or more silicon photodiodes, optical or electronic filters, temperature sensors, current sensors, or other devices as would be understood by a worker skilled in the art for sensing characteristics related to light generation by the lighting system. For example, measured temperature or current can be correlated to aspects of emitted light for a predefined light source. Electronics such as amplifiers, encoders, or the like can also be included with the feedback sensor to facilitate transmission of a feedback signal to the drive current controller, for example controller 11.

In one embodiment, the drive current controller, for example controller 11, can be a microprocessor, microcontroller, application specific integrated circuit, or other electronic device facilitating control or feedback control of the lighting system as would be understood by a worker skilled in the art. For example, the electronic device can provide control of currents supplied to the lighting system and/or the signal derivation module according to a predetermined user input, software or firmware instructions, volatile or nonvolatile memory, or other configuration means or input.

In one embodiment, the drive current controller, for example controller 11, includes electronic drive circuitry facilitating control or feedback control of the lighting system as would be understood by a worker skilled in the art. For example, the drive current controller can include controllable current sources such as analog current sources, PWM current sources, PCM current sources, random digital signal current sources, or other current sources as would be known in the art. Transistors, diodes, inductors, resistors, capacitors, operational amplifiers, and other components can be used to construct a current source in various embodiments of the present invention.

In one embodiment, the signal derivation module is a substantially self-contained module which is configurable to generate one or more secondary drive current signals based on one or more primary drive current signals. For example, the signal derivation module can monitor outputs of the controller and process this information to derive the one or more secondary drive current signals. The signal derivation module can contain components for this purpose such as a power source, microprocessor, or other elements as would be understood by a worker skilled in the art.

In one embodiment, the signal derivation module can be configured to operate using phantom power, supplied for example by the controller through control signal lines operatively coupled to the signal derivation module. For example, the signal derivation module can be configured to draw a substantially constant current for operation thereof, and the controller can boost current supplied on one or more control signal lines in compensation of the current drawn by the signal derivation module, without substantially affecting the control signals received by the signal derivation module and the current drivers.

In one embodiment, the signal derivation module is substantially integrated with the drive current controller. For example, with reference to FIG. 2, the signal derivation module 16 and the controller 11 can share components such as a microprocessor, power supply, housing, cooling system, user interface, or other elements as would be understood by a worker skilled in the art.

In one embodiment, the controller receives one or more signals representative of the operating temperature from one or more sensing devices and can be configured to determine control signals based on the desired colour of light and the operating temperature. The operating temperature can be correlated with the colour of light for feedback control using a predetermined correlation between temperature and colour of light emitted by the light-emitting elements. The operating temperature of the LEEs can be measured, for example by a temperature sensor such as a thermopile, thermistor, thermocouple or the like, or by correlating temperature with a voltage drop across the LEE. The light emitted by the light-emitting elements can be blended to substantially obtain the desired colour of light. The desired colour of light generated can thus be substantially independent of junction temperature induced changes in the operating characteristics of the light-emitting elements.

One or more optical systems can be provided in order to blend, redirect, shape or otherwise manipulate the light generated by the lighting system. The optical system can include one or more optical elements that can include filters, lenses, reflectors, diffusers, or other optical element format as would be readily understood by a worker skilled in the art.

Thermal management systems known in the art can be thermally coupled to the light sources in order to provide thermal management thereof. A thermal management system can be one or a combination of a heatsink, heat fin configuration, active or passive cooling systems, for example heat pipes, thermosyphons, thermoelectric coolers, fans, electro-aerodynamic pump or ionic pump, or other thermal management system as would be readily understood by a worker skilled in the art.

White-Light Lighting System

In one embodiment of the present invention, the lighting system is used as a white light lighting system. The signal derivation module is configured to implement a modulation parameter determination, which can provide the one or more secondary drive current signals. For example, white-light lighting systems employing dependent control can be implemented using a RGBA LEE based lighting system in which the signal derivation module can be configured to implement an intensity modulation parameter, $f_A$, for the amber LEEs is determined based on the modulation parameters $f_R$, of the red LEE(s), and $f_G$, of the green LEE(s) by:

$$f_A = c f_R^{r_R} f_G^{r_G} \tag{1}$$

wherein parameter c is a desired scaling constant, and exponent parameters $r_R$ and $r_G$ are suitably chosen positive real numbers such that all possible values for $f_A$ are in the range [0,c]. Each $f_R$, $f_G$ is within the range [0,1]. The scaling constant c can be used to match, scale-up or scale-down, within limits, the intensity of the amber colour light source relative to the intensities of the red and green colour light sources.

Similarly, other embodiments of the present invention may utilize fourth or further other colour light sources with any combination of any number of light source colours such as amber, yellow or cyan. The modulation parameters of the other colour light source(s) may be dependently controlled in a similar fashion as the amber light source or as a function of the modulation parameters of the blue and green or even the blue and red colour light sources, for example. It is noted that the control scheme according to Equation (1) may also be used to generate hues of off-white light.

In an example embodiment, $r_R$ and $r_G$ can both be 0.5 such that $f_A$ obeys a square root dependency on either $f_R$ or $f_G$ while the other one is fixed. A lighting system which is configured or controlled according to this method can generate light of desirably higher CRI. It is noted that other embodiments may utilize other values for $r_R$ or $r_G$ to determine the modulation parameter of amber or blue-green or both colour light sources.

In other embodiments of the present invention, modulation parameters for dependently controlled light sources can also be determined according to functions other than the power law dependency described in Equation (1). Alternative functions for the determination of the modulation parameters can include general functions, analytic functions (polynomial, logarithmic), or look-up relations, wherein each alternate function can provide a suitable number and combination of parameters and parameter ranges. For example, modulation parameters for dependently controlled light sources can be determined according to functions which can be described by a dependency such as can be described by:

$$f_{Dep} = g(f_1, f_2, \ldots) \tag{2}$$

where $f_{Dep}$ is the modulation parameter according to an output of the drive current derivation system, g(•) is a function of one or more variables, such as a combination of power law, square root, or alternative functions as described above, and $f_1$, $f_2$, . . . are the modulation parameters according to one or more outputs of the drive current controller.

In representing g(•) as a combination of single-variable functions, g(•) can be represented in one embodiment as:

$$g(f_1, f_2, \ldots) = \sum_{i=1}^{N_i} \left[ \prod_{j=0}^{N_j} g_{ij}(f_{i+j}) \right] \tag{3}$$

where $N_i$ and $N_j$ are suitably chosen parameters and $g_{ij}(\bullet)$ is a function of one variable for each i and j. For selected i and j, $g_{ij}(\bullet)$ can be substantially zero or one, for example as may be required to eliminate dependencies of g(•) on some modulation parameters of the drive current controller. For example, to recover Equation (1), $N_i=1$ and $N_j=1$ can be chosen, $g_{10}(f) = cf^{r_R}$, and $g_{11}(f)=f^{r_G}$, where $f_1=f_R$ and $f_2=f_G$. To add a third power law product dependency to Equation (1), $N_j=2$ can be chosen, and $g_{12}(f)=f^{r_3}$ can be defined, with $f_3$ defined as the modulation parameter of a third output of the drive current controller.

White light lighting systems can also be implemented using systems other than an RGB or RGBA based system. For example, light of differently coloured LEEs can be mixed according to embodiments of the present invention to provide a desired white light, provided that the desired white light is within the gamut defined by the differently coloured LEEs.

Non-White Light Lighting Systems

The ability to reproduce certain deeply saturated light colours with lighting systems can benefit from adequately dependently controlling some colour light sources within a multi-colour light source in a similar fashion as described above for the RGBA lighting system configuration.

Figure 3:
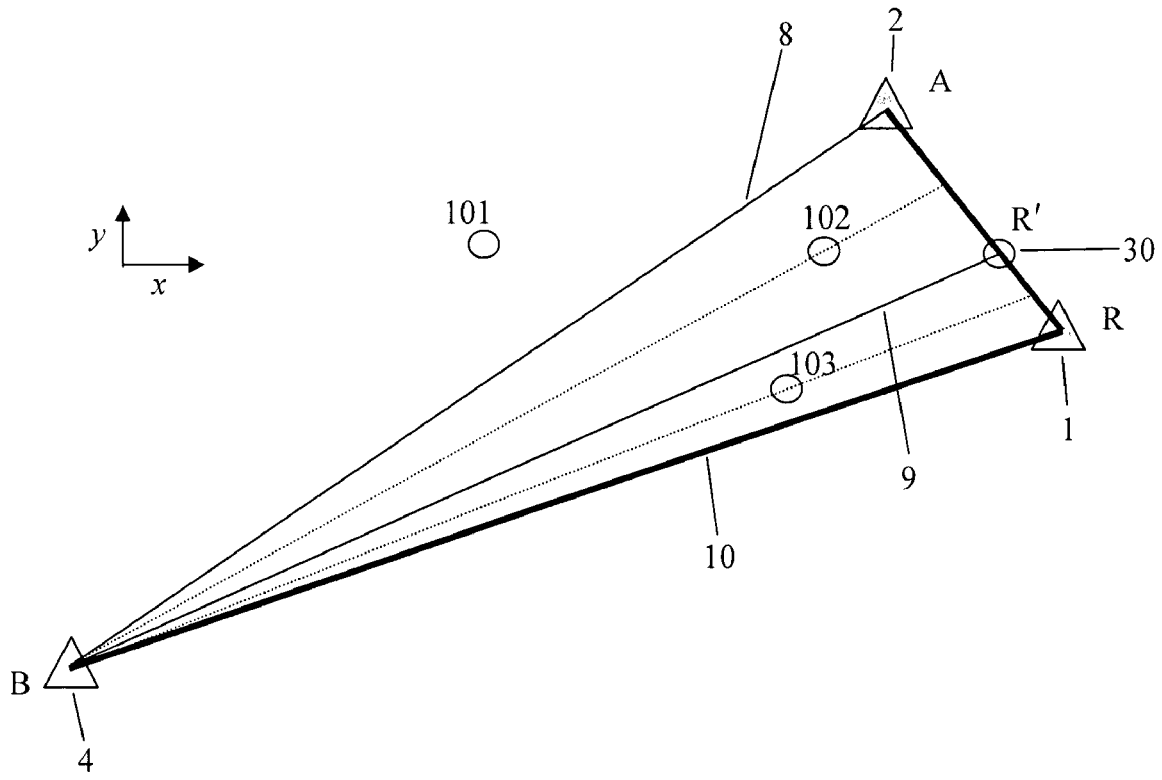
FIG. 3 illustrates a portion of a chromaticity diagram.

FIG. 3 shows a detail of the chromaticity diagram of FIG. 1. As illustrated, due to the proximity of amber and red in chromaticity space, the amber and red light sources may desirably be functionally closely coupled for chromaticities of the mixed light above line 8, which joins the blue 4 light source, i.e. the third independent colour light source, and the amber 2 light source chromaticity coordinates. For example, the amber and red light sources may be functionally closely coupled in that their intensities increase or decrease together, and further in that the intensities of amber and red light sources may become similar as the desired chromaticity is moved farther above line 8. If the mixed light is desired to have a chromaticity below line 8, it may be required to decouple the amber 2 light source from the red 1 light source. For example, the intensities of the amber and red light sources may no longer vary in a similar manner to each other when the desired chromaticity is below line 8, but may vary substantially independently. In determining the intensity of the amber light source as a function of the red light source below line 8, the coupling can preferably become gradually less as the coordinate of the desired chromaticity of the mixed light gains distance from line 8, so that substantially no undesirable colour discontinuity becomes observable. Besides intermixing adequate amounts of blue from the blue 4 light source, the desired chromaticity of the mixed light is determined by mixing adequate, independent amounts of red light and green light, while the amount of the fourth colour, amber, depends on the amounts of red and green. Depending on the application requirements and the bandwidths of the amber and red light sources, for example, if the lighting system may be required to generate deep saturated red light colours, the amount of amber light may be zero below line 9. Otherwise the amount of amber light may gradually drop off as a function of the distance from line 10. It is noted that the same types of considerations may apply to other pairs of proximate chromaticity light sources such as yellow and green or blue and cyan, for example.

For example, FIG. 3 illustrates point R' 30 which has chromaticity coordinates given by a weighted combination of the chromaticities of red 1 and amber 2 light sources according substantially to:

$$R' \equiv (x_{R'}, y_{R'}) = \left(\frac{1}{10}(x_A 9x_R), \frac{1}{10}(y_A + 9y_R)\right) \tag{4}$$

wherein $(x_A, y_A)$ and $(x_R, y_R)$ are the chromaticities in x-y coordinates or the respective amber and red light sources. It is noted that weights other than the 9:1 weighting of Equation (4) are possible, such as 1:1. More generally, a weighting a:b of red light to amber light, where a and b are positive numbers, would result in point R' having chromaticity coordinates according substantially to:

$$R' \equiv (x_{R'}, y_{R'}) = \left(\frac{1}{a+b}(bx_A ax_R), \frac{1}{a+b}(by_A + ay_R)\right) \tag{5}$$

If the desired chromaticity of the mixed light is above line 8, such as for example for point 101 of FIG. 3, the modulation parameter for the amber light source may then be, besides optional linear scaling to match intensities as described above, a ninth of that of the red light source. If the desired chromaticity of the mixed light is below line 9, such as for example for point 103 of FIG. 3, the amber light source intensity may simply be set to zero. If the desired chromaticity of the mixed light is between line 8 and line 9, such as for example for point 102 of FIG. 3, the amber light source intensity may linearly decrease from the value defined for the region above line 8 down to zero at line 9 with proportional with distance from line 8. As a result, the amber light source coupling factor varies gradually from zero at line 9 to, for example one ninth at line 8. It is noted that other embodiments of the present invention using RGB colour light sources with dependently controlled amber light sources may vary the amber light intensity in different ways.

In one embodiment of the present invention, as described, the amber light intensity relative to the intensity of the mixed light depends on a specific functional relationship in each of the three regions indicated by line 8 and line 9 in FIG. 3.

It is obvious that the foregoing embodiments of the invention are exemplary and can be varied in many ways. Such present or future variations are not to be regarded as a departure from the spirit and scope of the invention, and all such modifications as would be obvious to one skilled in the art are intended to be included within the scope of the following claims.

We claim:

1. A lighting system for controlling colour light sources comprising: (a) a drive current controller for providing one or more primary drive current signals; (b) one or more first groups of light-emitting elements, each first group operatively connected to the drive current controller and each first group responsive to a primary drive current indicative of one of the one or more primary drive current signals; (c) a signal derivation module operatively connected to the drive current controller for determining one or more secondary drive current signals; and (d) one or more second groups of light-emitting elements, each second group operatively connected to the signal derivation module and each second group responsive to a secondary drive current indicative of one of the one or more secondary drive current signals; wherein each of the one or more secondary drive current signals is predetermined based on at least one of the one or more primary drive current signals, wherein one of the one or more second groups of light-emitting elements includes amber light-emitting elements, and wherein the secondary drive current signal indicative of a drive current for the amber light-emitting elements is derived based on a predetermined relationship of the primary drive current signals associated with the red light-emitting elements and green light-emitting elements.

2. The lighting system according to claim 1, wherein light emitted by the amber light-emitting elements is reduced to about zero when light emitted by either the red light-emitting elements or the green light-emitting elements approaches zero.

3. The lighting system according to claim 1, wherein at least one of the one or more secondary drive current signals is predetermined based on a lookup table relationship with at least one of the one or more primary drive current signals.

4. The lighting system according to claim 1, wherein at least one of the one or more secondary drive currents is predetermined based on a piecewise combination of relationships with at least one of the one or more primary drive current signals, the piecewise combination of relationships including relationships selected from the group comprising a linear relationship, a power law relationship, a square root relationship, a polynomial relationship, a logarithmic relationship and a look-up table relationship.

5. The lighting system according to claim 1, wherein at least one of the one or more secondary drive current signals is predetermined based on a combination of relationships with at least two of the one or more primary drive current signals, the relationships being combined using one or more operations selected from the group comprising a sum operation, a difference operation, a product operation and a quotient operation.

6. The lighting system according to claim 1, wherein at least one of the one or more secondary drive current signals is predetermined based on a relationship with at least one of the one or more primary drive current signals, the relationship having a variable strength dependent on a desired colour of light to be generated by the lighting system.

7. The lighting system according to claim 1, wherein the one or more first groups of light emitting elements include red light-emitting elements, green light-emitting elements and blue light-emitting elements.

8. The lighting system according to claim 7, wherein the one or more second groups of light-emitting elements include amber light-emitting elements, cyan light emitting elements, yellow light emitting elements or a combination thereof.

9. A lighting system control method comprising the steps of: (a) determining one or more primary drive currents for driving one or more first groups of light-emitting elements, and (b) determining one or more secondary drive currents for driving one or more second groups of light-emitting elements, wherein each of the one or more secondary drive currents is predetermined based on at least one of the one or more primary drive currents, wherein at least one of the one or more secondary drive currents is predetermined based on a relationship with at least one of the one or more primary drive currents, the relationship having a variable strength dependent on a desired colour of light to be generated by the lighting system.

10. The lighting system control method according to claim 9, wherein the one or more first groups of light emitting elements include red light-emitting elements, green light-emitting elements and blue light-emitting elements and wherein one of the one or more second groups of light-emitting elements includes amber light-emitting elements, wherein a secondary drive current signal indicative of a drive current for the amber light-emitting elements is derived based on a predetermined relationship of primary drive current signals associated with the red light-emitting elements and green light-emitting elements.

11. The lighting system control method according to claim 9, wherein at least one of the one or more secondary drive currents is predetermined based on a lookup table relationship with at least one of the one or more primary drive currents.

12. The lighting system control method according to claim 9, wherein at least one of the one or more secondary drive currents is predetermined based on a piecewise combination of relationships with at least one of the one or more primary drive currents, the piecewise combination of relationships including relationships selected from the group comprising a linear relationship, a power law relationship, a square root relationship, a polynomial relationship, a logarithmic relationship and a look-up table relationship.

13. The lighting system control method according to claim 9, wherein at least one of the one or more secondary drive currents is predetermined based on a combination of relationships with at least two of the one or more primary drive currents, the relationships being combined using one or more operations selected from the group comprising a sum operation, a difference operation, a product operation and a quotient operation.

14. A lighting system for controlling colour light sources comprising: (a) a drive current controller for providing one or more primary drive current signals; (b) one or more first groups of light-emitting elements, each first group operatively connected to the drive current controller and each first group responsive to a primary drive current indicative of one of the one or more primary drive current signals; (c) a signal derivation module operatively connected to the drive current controller for determining one or more secondary drive current signals; and (d) one or more second groups of light-emitting elements, each second group operatively connected to the signal derivation module and each second group responsive to a secondary drive current indicative of one of the one or more secondary drive current signals; wherein at least one of the one or more secondary drive current signals is predetermined based on at least one of a lookup table relationship with at least one of the one or more primary drive current signals or a piecewise combination of relationships with at least one of the one or more primary drive current signals, the piecewise combination of relationships including relationships selected from the group consisting of a linear relationship, a power law relationship, a square root relationship, a polynomial relationship, and a logarithmic relationship.

15. A lighting system for controlling colour light sources comprising: (a) a drive current controller for providing one or more primary drive current signals; (b) one or more first groups of light-emitting elements, each first group operatively connected to the drive current controller and each first group responsive to a primary drive current indicative of one of the one or more primary drive current signals; (c) a signal derivation module operatively connected to the drive current controller for determining one or more secondary drive current signals; and (d) one or more second groups of light-emitting elements, each second group operatively connected to the signal derivation module and each second group responsive to a secondary drive current indicative of one of the one or more secondary drive current signals; wherein at least one of the one or more secondary drive current signals is predetermined based on a relationship with at least one of the one or more primary drive current signals, the relationship having a variable strength dependent on a desired colour of light to be generated by the lighting system.

16. A lighting system control method comprising the steps of: (a) determining one or more primary drive currents for driving one or more first groups of light-emitting elements, and (b) determining one or more secondary drive currents for driving one or more second groups of light-emitting elements, wherein each of the one or more secondary drive currents is predetermined based on at least one of the one or more primary drive currents, and wherein at least one of the one or more secondary drive currents is predetermined based on a lookup table relationship with at least one of the one or more primary drive currents.

17. A lighting system control method comprising the steps of: (a) determining one or more primary drive currents for driving one or more first groups of light-emitting elements, and (b) determining one or more secondary drive currents for driving one or more second groups of light-emitting elements, wherein each of the one or more secondary drive currents is predetermined based on at least one of the one or more primary drive currents, and wherein the one or more first groups of light emitting elements include red light-emitting elements, green light-emitting elements and blue light-emitting elements and wherein one of the one or more second groups of light-emitting elements includes amber light-emitting elements, wherein a secondary drive current signal indicative of a drive current for the amber light-emitting elements is derived based on a predetermined relationship of primary drive current signals associated with the red light-emitting elements and green light-emitting elements.

* * * * *